US006903288B2

(12) United States Patent
Varga

(10) Patent No.: US 6,903,288 B2
(45) Date of Patent: Jun. 7, 2005

(54) DIAL-DOWN SWITCHING SYSTEM AND METHOD

(75) Inventor: Dennis Varga, Waterford, MI (US)

(73) Assignee: Alps Automotive, Inc., Auburn Hills, MI (US)

( * ) Notice: Subject to any disclaimer, the term of this patent is extended or adjusted under 35 U.S.C. 154(b) by 169 days.

(21) Appl. No.: 10/364,985

(22) Filed: Feb. 12, 2003

(65) Prior Publication Data

US 2004/0154904 A1 Aug. 12, 2004

(51) Int. Cl.[7] ..... H01H 9/26
(52) U.S. Cl. ..... 200/200; 200/5 R; 200/6 A
(58) Field of Search ..... 200/5 R, 5 A, 200/6 A, 5 EA, 14, 18, 314

(56) References Cited

U.S. PATENT DOCUMENTS

| | | | | |
|---|---|---|---|---|
| 4,811,175 A | * | 3/1989 | DeSmet | 362/95 |
| 5,434,757 A | * | 7/1995 | Kashiwagi | 362/501 |
| 5,623,134 A | * | 4/1997 | Hayakawa | 200/5 R |
| 5,770,825 A | * | 6/1998 | Yamaguchi et al. | 200/5 R |
| 5,813,519 A | * | 9/1998 | Gotoh | 200/313 |
| 5,912,537 A | | 6/1999 | Yang | |
| 6,274,826 B1 | * | 8/2001 | Serizawa et al. | 200/5 R |
| 6,299,320 B1 | * | 10/2001 | Kato et al. | 362/23 |
| 6,445,082 B1 | | 9/2002 | Klauzenberg et al. | |
| 6,484,082 B1 | | 11/2002 | Millsap et al. | |
| 6,528,742 B2 | * | 3/2003 | Serizawa et al. | 200/5 R |
| 6,548,772 B2 | * | 4/2003 | Liburdi | 200/61.54 |
| 6,657,316 B1 | * | 12/2003 | Smith et al. | 307/10.1 |

FOREIGN PATENT DOCUMENTS

| | | |
|---|---|---|
| JP | 5-149054 | 6/1993 |
| JP | 7-229359 | 8/1995 |
| JP | 7-279534 | 10/1995 |
| JP | 10-169309 | 6/1998 |
| JP | 2002-27579 | 1/2002 |

OTHER PUBLICATIONS

Toyota Camry *2002 Owner's Manual*, pp. 18 and 19.
Toyota Cressida *1989 Owner's Manual*, pp. 10 and 11.
Accord *1997 Owner's Manual*, pp. 69 70.

* cited by examiner

*Primary Examiner*—Elvin Enad
*Assistant Examiner*—Lisa Klaus
(74) *Attorney, Agent, or Firm*—Brinks Hofer Gilson & Lione

(57) ABSTRACT

A window switch for a motor vehicle includes a first switch and a second switch. The first switch is position within a vehicle for selecting a window. The second switch is positioned adjacent to the first switch. A rotary motion of the second switch raises or lowers the selected window in discrete increments. A method of controlling the translation of multiple windows within a motor vehicle includes selecting one or more of a passenger or a driver side windows by activating one or more window keys and simultaneously raising or lowering one or more of the selected windows in discrete increments by activating a multifunction switch.

20 Claims, 5 Drawing Sheets

DIAL-DOWN SWITCHING SYSTEM AND METHOD

FIELD OF THE INVENTION

This invention relates to a vehicle, and more particularly, to a system and a method that control the windows of a vehicle.

BACKGROUND

There are several systems used to control the raising and lowering of a window within a vehicle. One method uses a handle rotatably connected to a worm gear and a pinion gear. As the handle rotates, the gears operate as a pair to transmit and translate the turning force of the handle to a linear force that raises and lowers the window. The motion, speed, and position of the window are manually controlled by the user, which can provide a very precise control.

Unfortunately, manual control requires occupants to have the strength to raise or lower a window regardless of the handle's position. When multiple windows need to be adjusted, it can be difficult to raise and lower these windows unless the occupant is seated adjacent to each of the handles. This can be very difficult, especially when there is only one occupant and that occupant is driving.

Power windows have overcome some of these disadvantages by using electric motors to generate the turning and twisting forces needed to raise or lower a window. Power windows can be operated by pushing a toggle switch firmly down and then releasing it. Often, additional toggle switches are placed near the driver so that the driver can separately operate all of the vehicle's windows. In these systems, each passenger window is controlled by an independent switch. To raise or lower a specific window, a specific switch must be selected and then actuated.

While many power windows are easy to operate, they do not provide the precise control that some manual systems provide. To open a window to a desired position, for example, an occupant must push a window switch down. Once a desired position is reached, the occupant must release the switch. As the switch transitions from a closed to an open state, the window will continue to move until the switch is fully open. As a result, it can be difficult to control the position of a window precisely. Moreover, it can be difficult to control the position of multiple windows as each switch can have different transition periods.

SUMMARY

The present invention is defined by the following claims. This description summarizes some aspects of the present embodiments and should not be used to limit the claims.

A window switch embodiment for a motor vehicle comprises a first switch and a second switch. Preferably, the first switch is positioned within the vehicle for selecting a window. Preferably, the second switch is positioned adjacent to the first switch. A rotary motion of the second switch raises or lowers the selected window in discrete increments.

A method of controlling the translation of multiple windows within a motor vehicle preferably comprises selecting one or more of a passenger or a driver side windows by activating one or more window keys and simultaneously raising or lowering one or more of the selected windows in discrete increments by activating a multifunction switch.

Further aspects and advantages of the invention are described below in conjunction with the present embodiments.

DESCRIPTION OF THE PRESENT EMBODIMENTS

The present embodiments of the system and method can be precisely configured and adjusted. When part of a window control system within a vehicle, the flexible system and method allows an occupant to control the translation of multiple windows through a single switch. Preferably, the system and method include a vent key that allows a controlled amount of air to pass between an interior and an exterior of a vehicle. In one embodiment, the system and method includes a memory key that can store and recall window positions.

Figure 1:
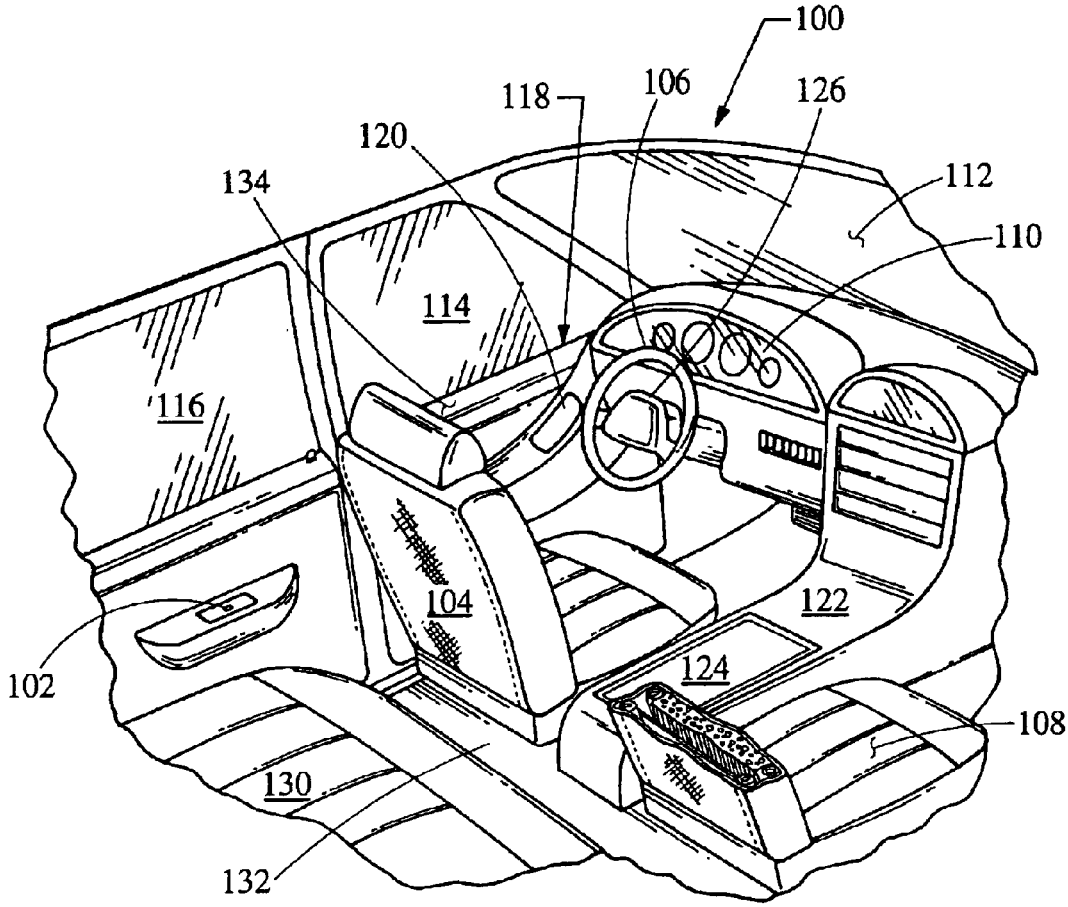
FIG. 1 is a cross-sectional view of a vehicle that includes a side perspective view of a driver's side and a passenger side embodiment.

FIG. 1 shows a cross-sectional view of a vehicle 100 that includes a side perspective view of a driver's side and a passenger side embodiment 120 and 1102. The vehicle 100 includes a driver's seat 104 positioned behind a steering wheel 106 and across from a right front passenger seat 108 and a rear passenger seat 130. Preferably, the driver and passenger seats 104, 108, and 130 are coupled to a frame 132. An instrument cluster 110 is also coupled to the frame 132 under a windshield 112. In the illustrated embodiment, a left front and a left rear window 114 and 116 are shown.

Preferably, a left front door panel 118 and trim 134 are positioned below the left front window 114. The driver's side embodiment 120 is shown coupled to the door panel 118 near the instrument cluster 110 but can be positioned anywhere within the vehicle 100 including a front or a center console 122, a front panel 124, or within a steering wheel control 126, for example. Preferably, the driver's side embodiment 120 can control a driver's left front window 114 and all of the passenger's window controls (one is shown as 1102). This means that the driver can raise and lower the left front 114, right front, left rear 116, and right rear windows of the vehicle 100.

Figure 2:
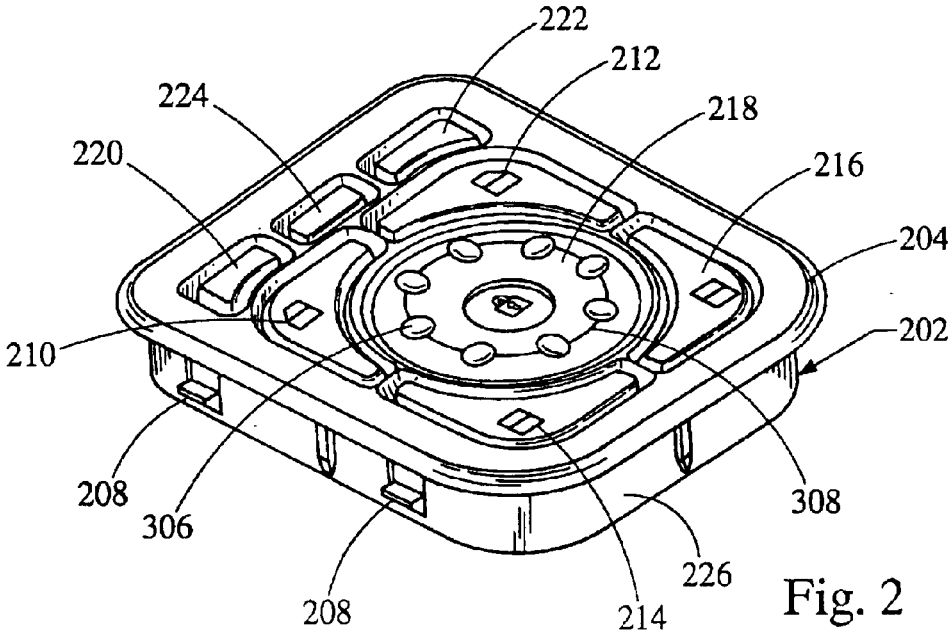
FIG. 2 is a top perspective view of the embodiment of FIG. 1.

Preferably, the driver's side embodiment 120 is comprised of a plurality of single function circuits and a multifunction circuit partially enclosed within a housing 202 shown in FIG. 2. In the illustrated embodiment, the housing 202 comprises a rectangular enclosure 226 partially covered by a protective plate or escutcheon 204. Preferably the escutcheon 204 has a beveled perimeter. Mounting tabs 208 projecting from the exterior side surfaces of the housing 202 securely attach the driver's side embodiment 120 to the left front door panel 118. Preferably, the openings passing through the escutcheon 204 provide access to the single and multi-function circuits. In this embodiments, the openings to the left front, right front, left rear, and right rear window keys 210, 212, 214, and 216 have a parabolic shape terminating at an arc, the opening to the rotary-rocker switch 218 has a circular shape, the openings to the memory keys 220 and 222 have a polygonal shape, and the opening to the vent key 224 has a rectangular shape.

Figure 3:
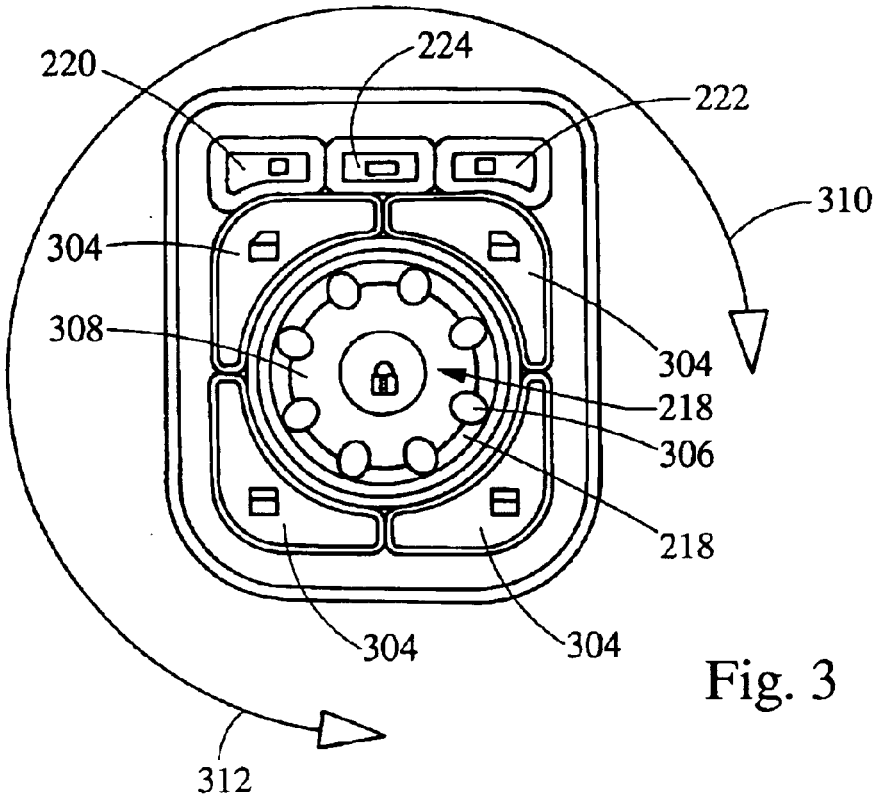
FIG. 3 is a top view of the embodiment of FIG. 1

In the illustrated embodiment of FIG. 3, the left front, right front, left rear, and right rear window keys 210, 212, 214, and 216 substantially surround the outer circumference of the multi-function circuit. In this embodiment the multi-function circuit comprises a rotary-rocker switch 218. Preferably, the left front, right front, left rear, and right rear window keys 210, 212, 214, and 216 are single function circuits comprised of momentary contact switches that select the windows to be maneuvered. These switches are activated when rubber domes press electrical contacts against each other. Once a window key is selected, the elasticity of the rubber dome restores the switch to a return position separating the electrical contacts and the window remains in an active (a.k.a. selected) state until that window key is pressed again. This movement selects or releases a window to be maneuvered.

When an occupant selects a window to be maneuvered, a pressing of a window key illuminates the selected window key to indicate that the selected window is active. Preferably, an illumination system transmits light through a translucent portion of the window key to indicate its selection. In this embodiment, the illumination system comprises a light source and a light guide that provide a uniform illumination of the selected keys and fills the activation apertures 304 passing through the selected window keys.

In this embodiment, the rotary-rocker switch 218 is positioned in one or more panel locations surrounded by the left front, right front, left rear, and right rear window keys 210, 212, 214, and 216, although the window keys 210, 212, 214, and/or 216 can have many other positions and configurations in other embodiments. The raised convex projections 306 positioned near the perimeter of a rotary disk 308 shown in FIGS. 2 and 3 (and FIG. 11 of the passenger side embodiment 1102) preferably allow an occupant to rotate the rotary-rocker switch 218 about a central axis 502 shown in FIG. 5 and through the contact points that determine the resolution of the switch. Preferably, the discrete electrical resistances 504 of these contact points are used to control the level of translation of the selected or active windows while the contact resistance holds the rotary-rocker switch 218 in a given position once an actuating torque is removed. The contact resistance of each contact point preferably acts as a detent that prevents a rotation of the rotary-rocker switch 218 until a minimum actuating torque is applied.

Figure 4:
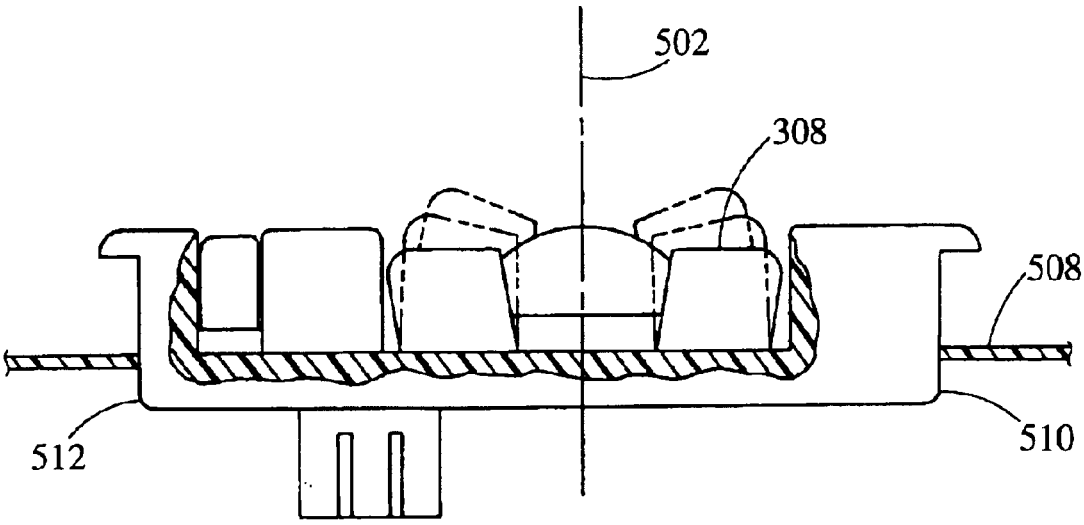
FIG. 4 is a side cross-sectional view of the embodiment of FIG. 1.

In the embodiment illustrated in FIG. 4, the rotary-rocker switch 218 can also rock about the central axis 502. Preferably, when pushed along a longitudinal axis 508, the rotary-rocker switch 218 provides an express-down or an express-up function. In this embodiment, when the rotary disk 308 is pushed toward a proximal end 510, each active window rolls completely down. This "one touch" function can help keep a driver's hands free. The driver can also roll up the active windows. By pushing the rotary-rocker switch 218 toward a distal end 512, the express-up function rolls the active windows completely up. When the express functions are inadvertently engaged, pressing the rotary-rocker switch 218 in an opposite direction of the original engagement disengages the respective functions.

Preferably, the rocker actuation shown in FIGS. 4 occurs when the extensions 514 shown in FIG. 5 disposed below the rotary disk 308 press electrical contacts together. In the enlarged view of FIG. 5, the extensions 514 are shown in an are shape terminating at a stair-step side boundary. At an upper surface 516, the extensions 514 press against a supporting enclosure 518 shown in rectangular cross-section. At a lower surface 520, stair step portions 524 that support one of the electrical contacts are positioned above triangular shaped bases 526 that support a second electrical contact. Preferably, the bases 526 are directly coupled to a power source 528 and the extensions 514 are connected to a fulcrum 530 that supports the supporting enclosure 518.

Preferably, a window lock key 532 is symmetric and partially concentric with the central axis 502. Preferably, the window lock key 532 comprises a contact switch having a rubber shaped dome coupled to one electrical contact disposed above a second electrical contact as shown in FIG. 5. When engaged, the window lock key 532 remains pressed down disabling all of the passenger's window controls. However, the driver's embodiment 120 can still control all of the passenger's windows. Preferably, the driver will feel a tactile feedback such as a soft snap as the window lock key 532 is engaged and disengaged. To disengage the window lock key 532, a driver presses the window lock key 532 down again. When pressed again, the driver feels another soft snap and the window lock key 532 returns to its original position.

Preferably, the driver's side embodiment 120 also includes a vent key 224. In the illustrated embodiments of FIG. 5, the vent key comprises a momentary switch. In this embodiment the momentary switch includes a rubber dome shown in an I-shaped cross-section terminating at an electrical contact disposed above a second electrical contact. When the vent key 224 is engaged, the rubber dome is pushed down to close the switch, which raises or lowers the active windows to a pre-selected position. Accordingly, each of the windows will translate an equal or an unequal length. While the programmed position of the windows can vary with each embodiment, preferably the venting position is intermediate of a fully closed and a half-open window position. In one exemplary embodiment, the vent key 224 opens the selected active windows to about a 25-millimeter opening. Once the vent key 224 is re-engaged, the vent key 224 preferably returns the active windows to a fully closed position.

The driver's side embodiment 120 can also include memory keys 220 and 222 that recall programmed window positions. Preferably, the memory keys 220 and 222 comprise momentary switches that include a rubber dome terminating at an electrical contact disposed above a second electrical contact. Pressing one of the momentary switches for a pre-determined period of time selects the memory function for that memory key. In this embodiment, the illumination system illuminates the selected memory key indicating that the active window positions will be recorded. After the driver adjusts the active windows, the memory records these active positions when the memory key is pressed again. When pressed again, the illumination system flashes the memory key to indicate that the recording was completed. Once a memory key is programmed, a brief pressing of that memory key will return the programmed windows to their recorded positions.

Figure 5:
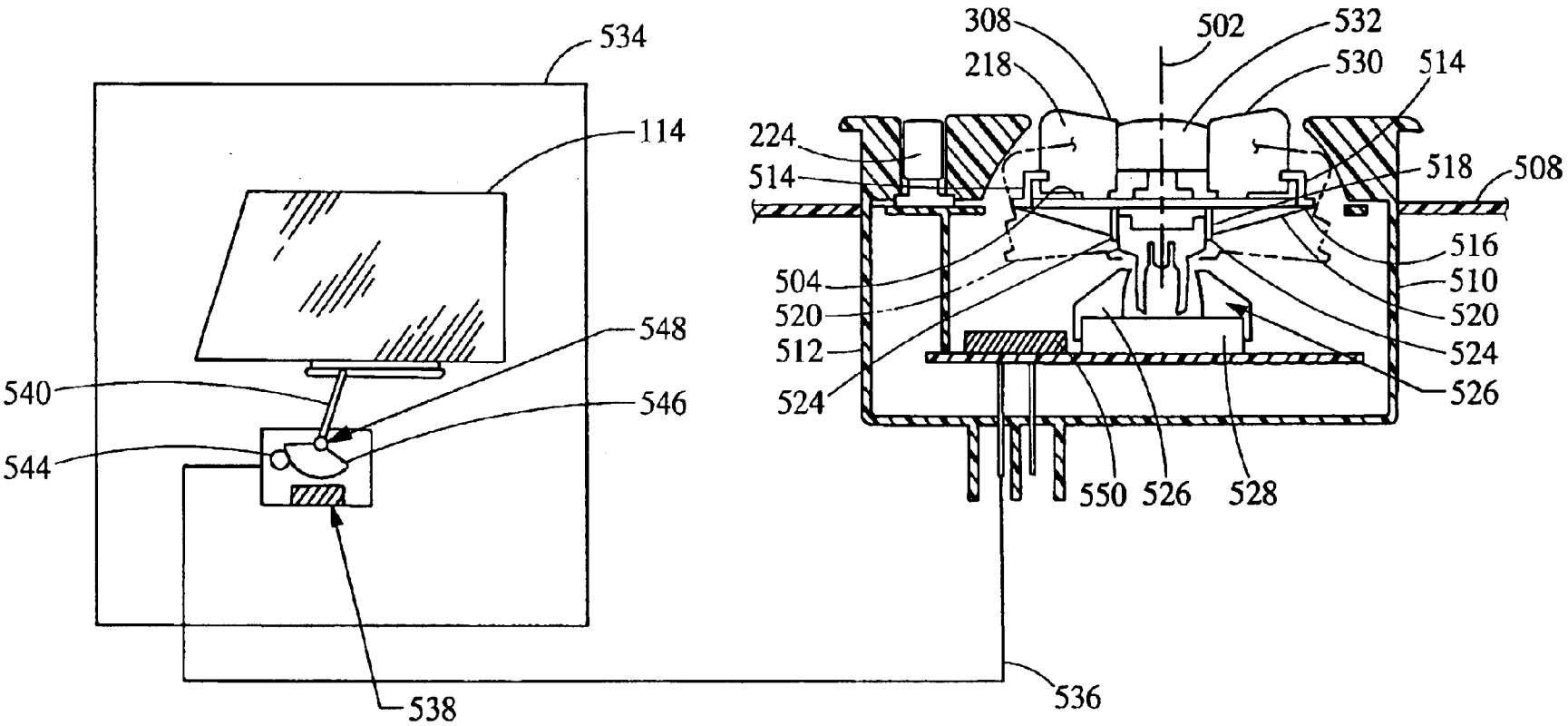
FIG. 5 is a side cross-sectional view of the driver's side embodiment coupled to a window.

FIG. 5 illustrates the side cross-sectional view of the driver's side embodiment 120 coupled to a window control system 534. Preferably, the driver side embodiment 120 is coupled to the window control system 534 by a data link. In this embodiment the data link comprises a vehicle bus 536 that has a group of lines (conductors) that carry different types of information. One group of lines can carry data; another can carry control signals; and in other embodiments, another can carry memory addresses or locations. In this illustration, a window control unit 538 responds to a driver's side control unit 5540. Preferably, a messaging protocol received over the vehicle bus 536 activates and maintains the operational state of the window control unit 538 until a requested task is completed. Upon receipt of the command from the vehicle bus 536, the window control unit 538 switches from a low power quiescent state that conserves power to an awakened state. The window control unit 538 then monitors the vehicle bus 536 and executes the requested task.

One way of raising or lowering a window is to raise or lower a linking arm 540 that is attached to a bottom portion of the window 114. To facilitate this description, the left front window 114 is shown in FIG. 5. In response to the control signals received from the window control unit 538, an electric motor 544 rotatably connected to a worm gear and spur gears 546 transmit a force that raises or lowers the linking arm 540. As the linking arm 540 is raised or lowered so is the window 114. Preferably, a sensor 548 linked to the window control unit 538 track and record the rotational motion of the motor shaft in its or the window control unit's 538 memory. This information allows the window control unit 538 to communicate the precise position of the window to another passenger or a driver control unit.

Preferably, the window control units 538 (one of which is illustrated in FIG. 5) that are associated with each of the left front 114, right front, left rear 116, and right rear windows prevent the pinching of fingers, hands, and other body parts. Preferably, the window control units 538 monitor window loads to sense differences between normal and abnormal conditions. When load values indicate an abnormal disparity, preferably window movements are stopped, and in some embodiments the window movements reversed. Variations in window loads may be derived from sensing window speeds or by monitoring the current flowing through the motor 544, for example. When a window experiences an unexpected load, the current flowing through the motor 544 may increase beyond an expected run current value in some embodiments.

Figure 6:
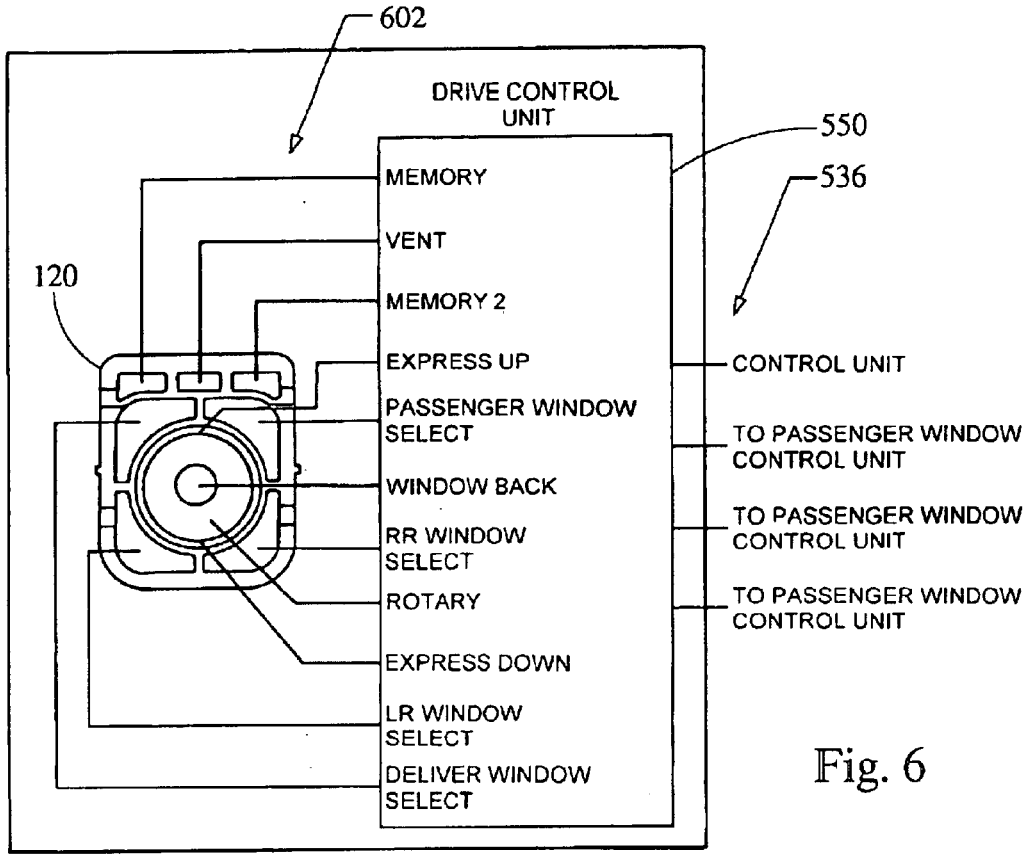
FIG. 6 is a top partial view of the driver's side embodiment coupled to a driver control unit.

In the embodiment shown in FIG. 6, the driver control unit 5540 is coupled to the single and multi-function circuits by a local bus 602. Although the local bus 602 is shown as a parallel bus it can also encompass a serial path or bus in other embodiments. Preferably, the driver control unit 5540 encompasses both logic and memory that provide the ability to decode and execute instructions and in some embodiments the ability to transfer information to and from other devices coupled to the vehicle bus 536. While the vehicle bus 536 is illustrated as a group of lines (conductors), it also encompasses a single transmission path that conveys electronic transmissions of one or more separate messages separately or simultaneously in one or both direction separated in time, space, or frequency (e.g., multiplexing).

Figure 7:
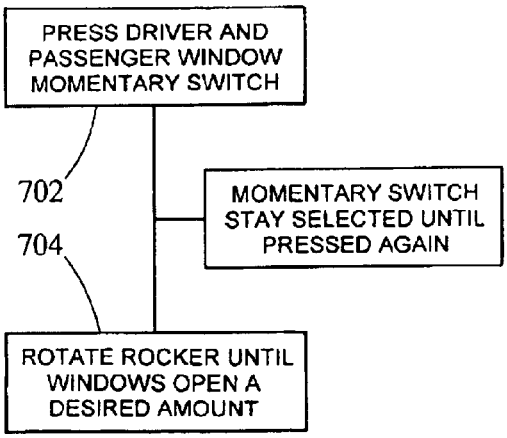
FIG. 7 is a flow diagram of controlling the translation of a selected window.

One method of opening multiple windows is shown in FIG. 7. To raise or lower a driver and/or passenger windows, a driver makes a selection. A pressing of one or more window keys 210, 212, 214, and/or 216 selects the windows to be maneuvered at act 702. Once selected, at act 704 a clockwise rotation 310 (shown in FIG. 3) of the rotary-rocker switch 218 lowers the windows selected at act 702. As the rotary-rocker switch 218 rotates through the contact points, preferably the selected windows are simultaneously lowered in substantially equal discrete increments such as in about 10 millimeter increments, for example. An inverse rotation of the rotary-rocker switch 218 in a counter clockwise direction 312 preferably raises the active windows in substantially equal discrete increments of about 10 millimeters.

Figure 8:
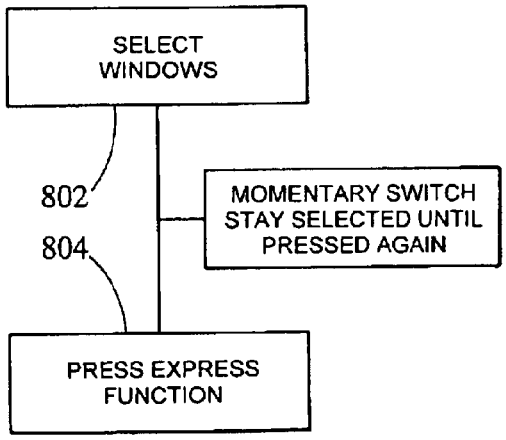
FIG. 8 is a flow diagram of an express function of an embodiment.

Another method of translating windows is shown in FIG. 8. To raise or lower driver and/or passenger windows in an express mode, a driver makes window selections. A pressing of one or more window keys 210, 212, 214, and/or 216 selects the windows at act 802. Once selected, pushing the rotary-rocker switch 218 to engage the electrical contacts located near the proximal end 510 fully opens the selected or active windows at act 804 simultaneously. When engaging the electrical contacts located near the distal end 512, the windows fully close simultaneously. Preferably window movements are separately stopped, and in some embodiments separately reversed when an abnormal load is detected.

Figure 9:
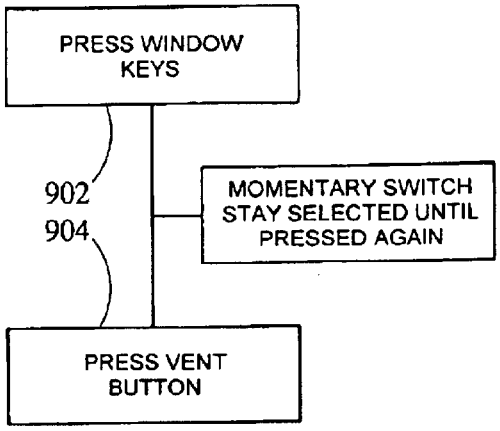
FIG. 9 is a flow diagram of a vent function of an embodiment.

Yet another method of translating windows is shown in FIG. 9. To vent an interior of a vehicle 100 a driver first makes window selections. A pressing of one or more window keys 210, 212, 214, and/or 216 selects the windows to be vented at act 902. Once selected, activating the vent key 224 simultaneously raises or lowers the selected windows to a discrete pre-selected position at act 904. In one exemplary embodiment, the selected windows will open to about 25 millimeters.

Figure 10:
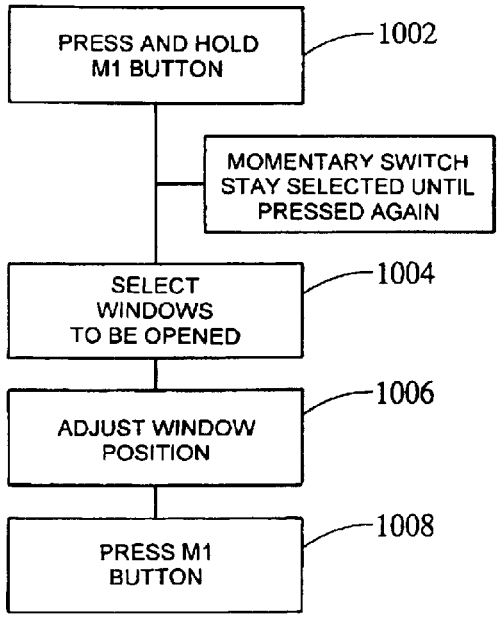
FIG. 10 is a flow diagram of a memory function of an embodiment.

Preferably, the driver's side embodiment 120 can also be programmed as shown in FIG. 10. Pressing one of the memory keys 220 or 224 for a pre-determined period of time selects the memory function at act 1002. A pressing of one or more window keys 210, 212, 214, and/or 216 selects the windows to be programmed at act 1004. Once selected, the windows can be adjusted to a desired position at act 1006. Once adjusted, the memory records these positions when the memory key is pressed again at act 1008.

Figure 11:
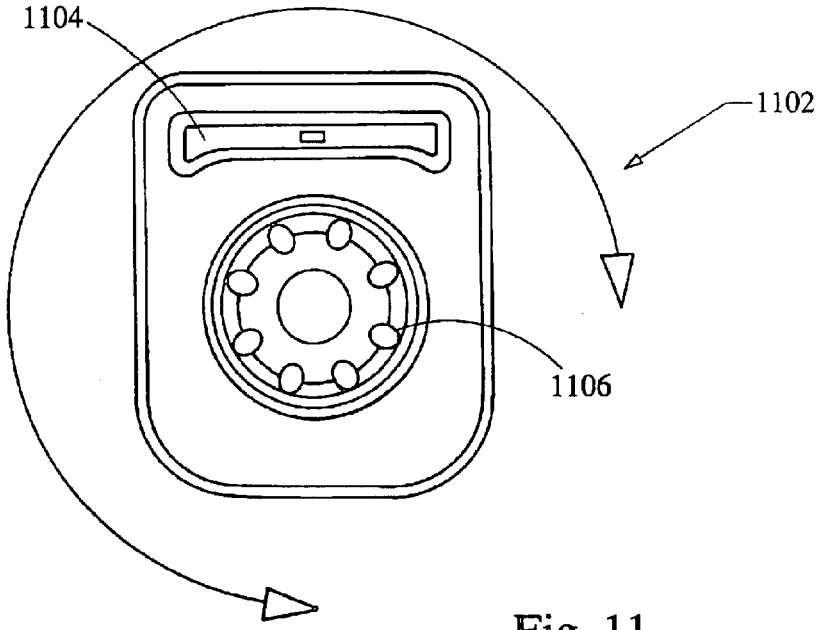
FIG. 11 is a top view of a passenger side embodiment.

FIG. 11 shows an alternative passenger side embodiment 1102 to the driver's side embodiments 120. In this passenger side embodiment 1102, the vent key 1104 and rotary-rocker switch 1106 control a single window. This embodiment can be interfaced to the driver's side embodiment through the vehicle bus 536 and the passenger side control unit 538 and can include a memory key. Preferably, the vent-key, rotary rocker switch, and memory key have the same mechanical and functional properties as the driver's side embodiments 120 described above.

Many other alternative embodiments are also possible. For example, the rotary-rocker switch used in the driver's side and passenger side embodiments 120 and 1102 can comprise a coded switch. In one embodiment, the coded switch comprises a rotary switch that converts dial positions into digital or custom coded numbers. Preferably, these digital number comprise binary coded decimal, binary (base 2), octal (base 8), hexadecimal (base 16), and/or a gray codes. In this embodiment adjustable stops can be provided to act as a detent or to control a range of motion of the switch and selected windows. Accordingly, this window control can comprise an entirely digital embodiment. In another alternative embodiment, the rotary rocker-rock switches of the driver's side and passenger side embodiments 120 and 1102 can comprise concentric shafts that share a common axis and are independently actuated. Preferably, this embodiment provides two or more separate switches in one panel location. Preferably, some of these independent switches can control other devices such as sunroofs, moon roofs, and other electrical loads of a vehicle 100, for example.

In yet another alternative embodiment, window select keys are provided for one or more ancillary windows. Preferably, the structure and functionality of a vent key, memory keys, and a rotary-rocker switch can control the ancillary windows too. In yet another embodiment, the discrete resistors 504 and rotary-rocker switch 218 shown in FIG. 5 can be replaced by a rotary switch that includes a potentiometer. In another alternative embodiment one or more of the momentary contact switches can be replaced with switches that maintain contact. Another alternative embodiments can also include a key-off delay function that allows the embodiments to function for a predetermined amount of time after an ignition of the vehicle 100 is turned off. In these embodiments, the opening of a front door preferably cancels the delay function.

When part of a vehicle having additional functionality, movable extensions and contacts similar to those shown in FIG. 5, are disposed along a latitudinal axis in alternative driver side and passenger side embodiments 120 and 1102. In these embodiments, an actuation of the rotary rocker switch along a latitudinal axis can raise or lower a window to another desired position like an analog switch or control an ancillary load.

The above-described system and method provides a reliable and precise means for controlling a window. When part of a vehicle, the system and method allows an occupant to precisely control the translation of one or more windows. Preferably, the system and method includes a multi-function switch that can simultaneously raise or lower windows in precise and substantially equal increments and roll the windows up or down with one touch. Preferably, a vent key allows the occupants to ventilate an interior of a vehicle by raising or lowering one or more pre-selected windows and a memory key allows occupants to raise or lower windows to an occupant programmed position. Preferably, the system and method can be used as a single or multi-window control. While the embodiments have been described as a driver or a passenger side embodiment, any combination of embodiments can be used interchangeably. Moreover, the passenger and driver side embodiments 1102 can include as much, more, or less functionality as described above.

While some embodiments of the invention have been described, it should be apparent that many more embodiments and implementations are possible and are within the scope of this invention. It is intended that the foregoing detailed description be regarded as illustrative rather than limiting, and that it be understood that it is the following claims, including all equivalents, that are intended to define the spirit and scope of this invention.

What is claimed is:

1. A window switch for a motor vehicle comprising:

a first switch disposed within a vehicle for selecting a window;

a second switch disposed adjacent to the first switch for raising or lowering the selected window in discrete and substantially equal increments through a rotary motion; and a vent key coupled to the first switch that controls the raising or lowering of the selected window to the pre-selected position.

2. The window switch of claim 1 wherein the first switch comprises a momentary contact switch.

3. The window switch of claim 1 wherein the second switch comprises two separate switches in a single panel location.

4. The window switch of claim 3 wherein the second switch comprises a rotary switch.

5. The window switch of claim 1 further comprising a memory key for controlling a translation of the window to an occupant programmed position.

6. A motor vehicle window switch comprising:

a plurality of switches for selecting a window;

a second switch disposed adjacent to the plurality of switches for controlling a variable translation of the selected window;

a third switch disposed adjacent to a first and the second switch for controlling a predetermined translation of the selected window; and a fourth switch disposed adjacent to the first, second, and third switch for controlling a user programmed translation of the selected window.

7. The motor vehicle switch of claim 6 wherein the plurality of switches select one of a passenger or driver side window.

8. The motor vehicle window switch of claim 7 wherein the second switch comprises a rotary switch that controls the raising or lowering of the selected window in discrete and substantially equal lengths.

9. The motor vehicle window switch of claim 8 wherein the fourth switch comprises a memory key.

10. The motor vehicle window switch of claim 7 wherein the window comprises a left front, right front, left rear, and/or right rear window.

11. The motor vehicle window switch of claim 6 wherein the second switch comprises a multifunction switch that can raise or lower a window with one touch and can raise or lower a window in discrete lengths through a rotary motion.

12. The motor vehicle window switch of claim 11 wherein the multifunction switch can disable all passenger controls.

13. The motor vehicle window switch of claim 6 further comprising a window control unit electrically coupled to the second switch through a vehicle bus, the window control unit being programmed to sense the difference between a normal and an abnormal load condition.

14. The motor vehicle window switch of claim 6 wherein the third, fourth, and the plurality of switches comprise momentary switches.

15. The motor vehicle window switch of claim 6 wherein the predetermined translation comprises positioning the windows to about a 25-millimeter opening.

16. The motor vehicle window switch of claim 6 wherein the plurality of switches select more than one window and the second switch controls the simultaneous translation of more than one window.

17. A method of controlling the translation of multiple windows within a motor vehicle comprising:

selecting more than one of a passenger or a driver side windows by activating more than one window keys; and raising or lowering more than one of the selected windows in discrete and about equal increments simultaneously by activating a multifunction switch, wherein the multifunction switch comprises two switches each of the two switches being configured to separately raise and lower the selected windows.

18. The method of claim 17 wherein the multifunction switch moves in a circular motion that can stop at several positions within a translating range.

19. The method of claim 17 wherein the multifunction switch comprises a digital switch that converts positions into a digital output.

20. The method of claim 17 wherein one of the two switches is configured to raise the selected windows entirely up in response to a single discrete touch of the one switch and lower the selected windows entirely down in response to a second single discrete touch.

* * * * *